US012121055B2

(12) United States Patent
Seo et al.

(10) Patent No.: US 12,121,055 B2
(45) Date of Patent: Oct. 22, 2024

(54) CIGARETTE FOR AEROSOL GENERATING DEVICE AND AEROSOL GENERATING DEVICE USING CIGARETTE

(71) Applicant: KT&G CORPORATION, Daejeon (KR)

(72) Inventors: Man Seok Seo, Seoul (KR); Jin Chul Yang, Sejong (KR); Soo Ho Kim, Cheongju-si (KR); Jong Yeol Kim, Sejong (KR)

(73) Assignee: KT&G CORPORATION, Daejeon (KR)

( * ) Notice: Subject to any disclaimer, the term of this patent is extended or adjusted under 35 U.S.C. 154(b) by 581 days.

(21) Appl. No.: 16/975,603

(22) PCT Filed: Nov. 15, 2019

(86) PCT No.: PCT/KR2019/015610
§ 371 (c)(1),
(2) Date: Aug. 25, 2020

(87) PCT Pub. No.: WO2020/105965
PCT Pub. Date: May 28, 2020

(65) Prior Publication Data

US 2021/0000168 A1 Jan. 7, 2021

(30) Foreign Application Priority Data

Nov. 23, 2018 (KR) ..... 10-2018-0146474

(51) Int. Cl.
*A24D 3/10* (2006.01)
*A24F 40/46* (2020.01)

(52) U.S. Cl.
CPC ..... *A24D 3/10* (2013.01); *A24F 40/46* (2020.01)

(58) Field of Classification Search
CPC ..... A24D 3/10; A24F 40/46
See application file for complete search history.

(56) References Cited

U.S. PATENT DOCUMENTS

| | | | |
|---|---|---|---|
| 5,692,526 | A | 12/1997 | Adams et al. |
| 10,306,919 | B2 | 6/2019 | Jeong et al. |
| 2012/0118309 | A1 | 5/2012 | Taniguchi |
| 2013/0112214 | A1 | 5/2013 | Bundren et al. |

(Continued)

FOREIGN PATENT DOCUMENTS

| | | | |
|---|---|---|---|
| CN | 102948924 | A | 3/2013 |
| CN | 105658852 | A | 6/2016 |

(Continued)

OTHER PUBLICATIONS

Communication dated Mar. 29, 2021 from the Korean Intellectual Property Office in Application No. 10-2018-146474.

(Continued)

*Primary Examiner* — Christopher M Rodd
*Assistant Examiner* — Daniel Edward Vakili
(74) *Attorney, Agent, or Firm* — Sughrue Mion, PLLC

(57) ABSTRACT

A cigarette for an aerosol generating device includes a tobacco rod including an aerosol generating substrate wrapped with a wrapper and a filter through which an aerosol generated from the aerosol generating substrate passes. The filter comprises cellulose acetate tow having a total denier of a preset value.

3 Claims, 7 Drawing Sheets

(56) References Cited

U.S. PATENT DOCUMENTS

| | | | | |
|---|---|---|---|---|
| 2016/0037824 | A1 | 2/2016 | Jordil | |
| 2016/0106147 | A1 | 4/2016 | Lisan et al. | |
| 2016/0128378 | A1 | 5/2016 | Kuersteiner et al. | |
| 2016/0219930 | A1 | 8/2016 | Reed et al. | |
| 2017/0006912 | A1 | 1/2017 | Shibagaki et al. | |
| 2017/0099871 | A1* | 4/2017 | Karkane | A24D 3/06 |
| 2019/0223493 | A1 | 7/2019 | Jeong et al. | |
| 2020/0214338 | A1* | 7/2020 | Whiffen | A24D 3/02 |
| 2020/0281261 | A1* | 9/2020 | Yamauchi | A24D 3/06 |

FOREIGN PATENT DOCUMENTS

| | | | |
|---|---|---|---|
| CN | 106163302 | A | 11/2016 |
| CN | 106539126 | A | 3/2017 |
| EP | 2454955 | A2 | 5/2012 |
| EP | 3 106 044 | A1 | 12/2016 |
| EP | 3818872 | A1 | 5/2021 |
| JP | 7-278961 | A | 10/1995 |
| JP | 2009-525746 | A | 7/2009 |
| JP | 2018-27881 | A | 2/2018 |
| KR | 10-2015-0077272 | A | 7/2015 |
| KR | 10-2016-0007689 | A | 1/2016 |
| KR | 10-2016-0018570 | A | 2/2016 |
| KR | 10-2016-0054505 | A | 5/2016 |
| KR | 10-2016-0069064 | A | 6/2016 |
| KR | 10-2017-0019336 | A | 2/2017 |
| WO | 2007/091181 | A2 | 8/2007 |
| WO | 2014/154887 | A1 | 10/2014 |
| WO | 2015/007400 | A1 | 1/2015 |
| WO | 2015/136573 | A1 | 9/2015 |

OTHER PUBLICATIONS

Office Action dated Nov. 18, 2022 from the Chinese Patent Office in Application No. 201980013828.1.

Extended European Search Report dated Dec. 22, 2021 from the European Patent Office in EP Application No. 19886273.2.

Communication dated Apr. 11, 2022 from the Korean Intellectual Property Office in KR Application No. 10-2021-0188878.

International Search Report for PCT/KR2019/015610 dated Feb. 26, 2020 (PCT/ISA/210).

Office Action issued Jun. 2, 2023 by China National Intellectual Property Administration in Chinese Application No. 201980013828.1.

Communication dated Sep. 14, 2021 from the Japanese Patent Office in Application No. 2020-567736.

* cited by examiner

CIGARETTE FOR AEROSOL GENERATING DEVICE AND AEROSOL GENERATING DEVICE USING CIGARETTE

CROSS REFERENCE TO RELATED APPLICATIONS

This application is a National Stage of International Application No. PCT/KR2019/015610 filed on Nov. 15, 2019, claiming priority based on Korean Patent Application No. 10-2018-0146474 filed on Nov. 23, 2018.

TECHNICAL FIELD

One or more embodiments of the present disclosure relate to a cigarette for an aerosol generating device and an aerosol generating device using the same, and more particularly, to a cigarette for an aerosol generating device that has improved effects by limiting physical and chemical values included in the cigarette for an aerosol generating device to a certain range, and an aerosol generating device using the same.

BACKGROUND ART

Recently, demand for alternative ways of overcoming the disadvantages of traditional cigarettes has increased. For example, there is growing demand for a method of generating aerosol by heating an aerosol generating material in cigarettes, rather than by combusting cigarettes. Accordingly, research into a heating-type cigarette and a heating-type aerosol generator has been actively conducted.

When a user smokes using an existing heating-type cigarette or an existing heating-type aerosol generating device, due to insufficient atomization amount, a satisfaction level of smoking is significantly lower than when smoking using a conventional combustion-type cigarette. Therefore, research has been conducted in various ways to solve the problem.

DESCRIPTION OF EMBODIMENTS

Technical Problem

One or more embodiments of the present disclosure provide a cigarette for an aerosol generating device that generates rich amount of atomization and an aerosol generating device using the same.

Solution to Problem

According to an aspect of the present disclosure, a cigarette includes a tobacco rod in which an aerosol generating substrate is wrapped with a wrapper and a filter through which an aerosol generated from the aerosol generating substrate passes, wherein the filter comprises cellulose acetate tow having a total denier of 22,000 to 25,000.

Advantageous Effects of Disclosure

According to one or more embodiments of the present disclosure, the cigarette for an aerosol generating device may improve use's smoking satisfaction than the existing aerosol generating device.

BEST MODE

Figure 1:
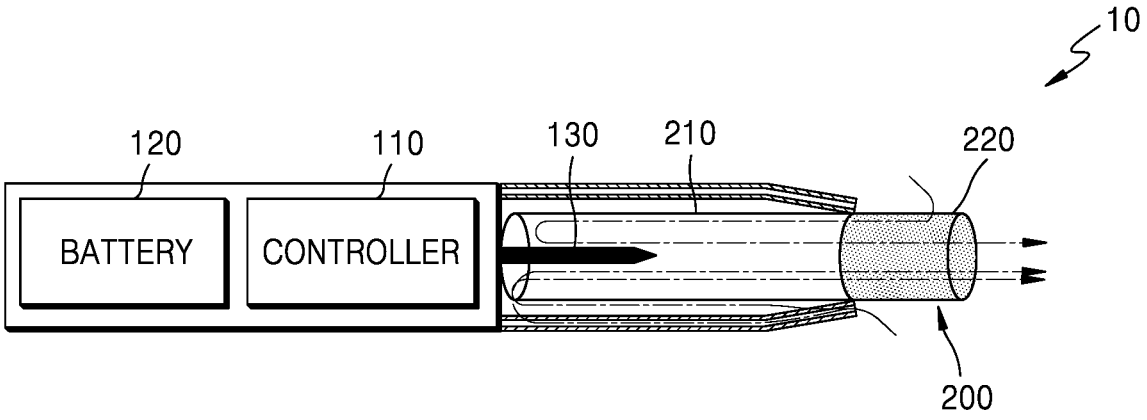
FIGS. 1 to 3 are diagrams illustrating examples of a cigarette inserted into an aerosol generating device.

According to an aspect of the present disclosure, a cigarette includes a tobacco rod including an aerosol generating substrate wrapped with a wrapper; and a filter through which an aerosol generated from the aerosol generating substrate passes, wherein the filter comprises cellulose acetate tow having a total denier in a range of 22,000 to 25,000.

The total denier within the cigarette may be a value selected from within a preset range.

The total denier within the cigarette may be 25,000.

The filter within the cigarette may include a cellulose acetate tow filter comprising cellulose acetate tow having a mono denier of a preset value less than or equal to 13.

The mono denier within the cigarette may be in the range of 9 to 13.

The filter may be comprising acetate tow having a Y-shaped cross-sectional area.

The filter may be comprising acetate tow having an O-shaped cross-sectional area.

The filter may include a cellulose acetate tow filter comprising cellulose acetate tow having a mono denier in the range of 10 to 12.

The filter may include a cellulose acetate tow filter comprising cellulose acetate tow having a mono denier of 11.7.

The filter may include a cellulose acetate tow filter comprising cellulose acetate tow having a mono denier of 9.

The filter may include a cellulose acetate tow filter comprising cellulose acetate tow to which a plasticizer in a range of 12% to 24% is applied.

The filter may comprise cellulose acetate tow having a mono denier of a reference value, and the reference value may be a value that lowers suction resistance of the filter to be lower than a preset value.

The filter may comprise cellulose acetate tow having a mono denier of a reference value, and the reference value may be a value that raises hardness of the filter to be greater than a preset value.

According to another aspect of the present disclosure, an aerosol generating device for heating the above-described cigarette to generate aerosol is provided.

Mode of Disclosure

As the present disclosure allows for various changes and numerous embodiments, particular embodiments will be illustrated in the drawings and described in detail in the written description. The attached drawings for illustrating one or more embodiments are referred to in order to gain a sufficient understanding, the merits thereof, and the objectives accomplished by the implementation. However, the embodiments may have different forms and should not be construed as being limited to the descriptions set forth herein.

The example embodiments will be described below in more detail with reference to the accompanying drawings. Those components that are the same or are in correspondence are rendered the same reference numeral regardless of the figure number, and redundant explanations are omitted.

While such terms as "first," "second," etc., may be used to describe various components, such components are not be limited to the above terms. The above terms are used only to distinguish one component from another.

An expression used in the singular encompasses the expression of the plural, unless it has a clearly different meaning in the context.

In the present specification, it is to be understood that the terms "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

When a certain embodiment may be implemented differently, a specific process order may be performed differently from the described order. For example, two consecutively described processes may be performed substantially at the same time or performed in an order opposite to the described order.

Hereinafter, embodiments of the present disclosure will be described in detail with reference to the drawings.

Figure 2:
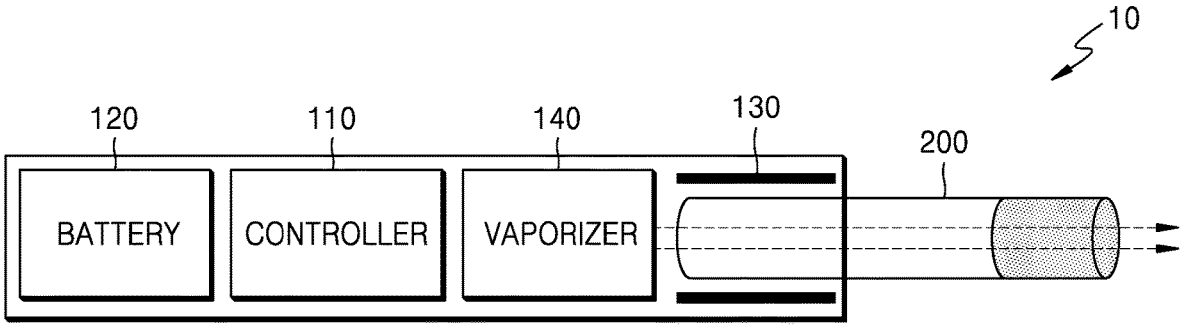
Figure 3:
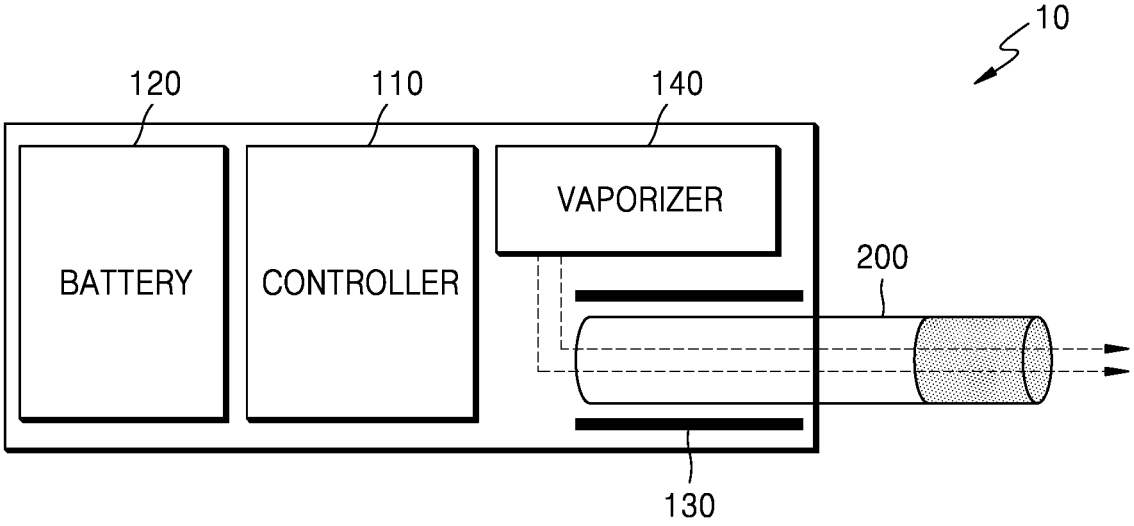

FIGS. 1 to 3 are diagrams showing examples in which a cigarette is inserted into an aerosol generator.

Referring to FIG. 1, an aerosol generator 10 includes a battery 120, a controller 110, and a heater 130. Referring to FIG. 2 and FIG. 3, the aerosol generator 10 further includes a vaporizer 140. Also, a cigarette 200 may be inserted into an inner space of the aerosol generator 10.

The elements related to the embodiment are illustrated in the aerosol generator 10 of FIGS. 1 to 3. Therefore, one of ordinary skill in the art would appreciate that other universal elements than the elements shown in FIGS. 1 to 3 may be further included in the aerosol generator 10.

Also, FIGS. 2 and 3 show that the aerosol generator 10 includes the heater 130, but if necessary, the heater 130 may be omitted.

In FIG. 1, the battery 120, the controller 110, and the heater 130 are arranged in a row. Also, FIG. 2 shows that the battery 120, the controller 110, the vaporizer 140, and the heater 130 are arranged in a row. Also, FIG. 3 shows that the vaporizer 140 and the heater 130 are arranged in parallel with each other. However, an internal structure of the aerosol generator 10 is not limited to the examples shown in FIGS. 1 to 3. That is, according to a design of the aerosol generator 10, the arrangement of the battery 120, the controller 110, the heater 130, and the vaporizer 140 may be changed.

When the cigarette 200 is inserted into the aerosol generator 10, the aerosol generator 10 operates the heater 130 and/or the vaporizer 140 to generate aerosol from the cigarette 200 and/or the vaporizer 140. The aerosol generated by the heater 130 and/or the vaporizer 140 may be transferred to a user via the cigarette 200.

If necessary, even when the cigarette 200 is not inserted in the aerosol generator 10, the aerosol generator 10 may heat the heater 130.

The battery 120 supplies the electric power used to operate the aerosol generator 10. For example, the battery 120 may supply power for heating the heater 130 or the vaporizer 140 and supply power for operating the controller 110. In addition, the battery 120 may supply power for operating a display, a sensor, a motor, and the like installed in the aerosol generator 10.

The controller 110 controls the overall operation of the aerosol generator 10. In detail, the controller 110 may control operations of other elements included in the aerosol generator 10, as well as the battery 120, the heater 130, and the vaporizer 140. Also, the controller 110 may check the status of each component in the aerosol generator 10 to determine whether the aerosol generator 10 is in an operable state.

The controller 110 includes at least one processor. A processor can be implemented as an array of a plurality of logic gates or can be implemented as a combination of a general-purpose microprocessor and a memory in which a program executable in the microprocessor is stored. It will be understood by one of ordinary skill in the art that the present disclosure may be implemented in other forms of hardware.

The heater 130 may be heated by the electric power supplied from the battery 120. For example, when the cigarette 200 is inserted in the aerosol generator 10, the heater 130 may be located outside the cigarette 200 Therefore, the heated heater 130 may raise the temperature of an aerosol generating material in the cigarette 200.

The heater 130 may be an electro-resistive heater. For example, the heater 130 includes an electrically conductive track, and the heater 130 may be heated as a current flows through the electrically conductive track. However, the heater 130 is not limited to the above example, and any type of heater may be used provided that the heater is heated to a desired temperature. Here, the desired temperature may be set in advance on the aerosol generator 10, or may be set by a user.

In addition, in another example, the heater 130 may include an induction heating-type heater. In detail, the heater 130 may include an electrically conductive coil for heating the cigarette 200 in an induction heating method, and the cigarette may include a susceptor that may be heated by the induction heating-type heater.

For example, the heater may include a tubular-type heating element, a plate-type heating element, a needle-type heating element, or a rod-type heating element, and may heat the inside or outside of the cigarette 200 according to the shape of the heating element.

Also, there may be a plurality of heaters 130 in the aerosol generator 10. Here, the plurality of heaters 130 may be arranged to be inserted into the cigarette 200 or on the outside of the cigarette 200. Also, some of the plurality of heaters 130 may be arranged to be inserted into the cigarette 200 and the other may be arranged on the outside of the cigarette 200. In addition, the shape of the heater 130 is not limited to the example shown in FIGS. 1 to 3, but may be manufactured in various shapes.

The vaporizer 140 may generate aerosol by heating a liquid composition, and the generated aerosol may be delivered to the user after passing through the cigarette 200. In other words, the aerosol generated by the vaporizer 140 may move along an air flow passage of the aerosol generator 10, and the air flow passage may be configured for the aerosol generated by the vaporizer 140 to be delivered to the user through the cigarette 200.

For example, the vaporizer 140 may include a liquid storage unit, a liquid delivering unit, and a heating element, but is not limited thereto. For example, the liquid storage unit, the liquid delivering unit, and the heating element may be included in the aerosol generator 10 as independent modules.

The liquid storage may store a liquid composition. For example, the liquid composition may be a liquid including a tobacco-containing material including a volatile tobacco flavor component, or a liquid including a non-tobacco material. The liquid storage unit may be detachably attached to the vaporizer 140 or may be integrally manufactured with the vaporizer 140.

For example, the liquid composition may include water, solvents, ethanol, plant extracts, flavorings, flavoring agents, or vitamin mixtures. The flavoring may include, but is not limited to, menthol, peppermint, spearmint oil, various fruit flavoring ingredients, etc. The flavoring agent may include components that may provide the user with various flavors or tastes. Vitamin mixtures may be a mixture of at least one of vitamin A, vitamin B, vitamin C, and vitamin E, but are not limited thereto. Also, the liquid composition may include an aerosol former such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivering unit. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 140 may be referred to as a cartomizer or an atomizer, but is not limited thereto.

In addition, the aerosol generator 10 may further include universal elements, in addition to the battery 120, the controller 110, the heater 130, and the vaporizer 140. For example, the aerosol generator 10 may include a display capable of outputting visual information and/or a motor for outputting tactile information. In addition, the aerosol generator 10 may include at least one sensor (a puff sensor, a temperature sensor, a cigarette insertion sensor, etc.) Also, the aerosol generator 10 may be manufactured to have a structure, in which external air may be introduced or internal air may be discharged even in a state where the cigarette 200 is inserted.

Although not shown in FIGS. 1 to 3, the aerosol generator 10 may configure a system with an additional cradle. For example, the cradle may be used to charge the battery 120 of the aerosol generator 10. Alternatively, the heater 130 may be heated while the cradle and the aerosol generator 10 are coupled to each other.

The cigarette 200 may be similar to a typical burning cigarette. For example, the cigarette 200 may include a first portion containing an aerosol generating material and a second portion including a filter and the like. The second portion of the cigarette 200 may also include the aerosol generating material. For example, an aerosol generating material made in the form of granules or capsules may be inserted into the second portion.

The entire first portion may be inserted into the aerosol generator 10, and the second portion may be exposed to the outside. Alternatively, only a portion of the first portion may be inserted into the aerosol generator 10 or the entire first portion and a portion of the second portion may be inserted into the aerosol generator 10. The user may puff aerosol while holding the second portion by the mouth of the user. At this time, the aerosol is generated by as the outside air passes through the first portion, and the generated aerosol passes through the second portion and is delivered to a user's mouth.

For example, the outside air may be introduced through at least one air passage formed in the aerosol generator 10. For example, opening and closing of the air passage and/or the size of the air passage may be adjusted by a user. Accordingly, the amount and quality of vapor may be adjusted by the user. In another example, the outside air may be introduced into the cigarette 200 through at least one hole formed in a surface of the cigarette 200.

Hereinafter, an example of the cigarette 200 will be described with reference to FIG. 4.

Figure 4:
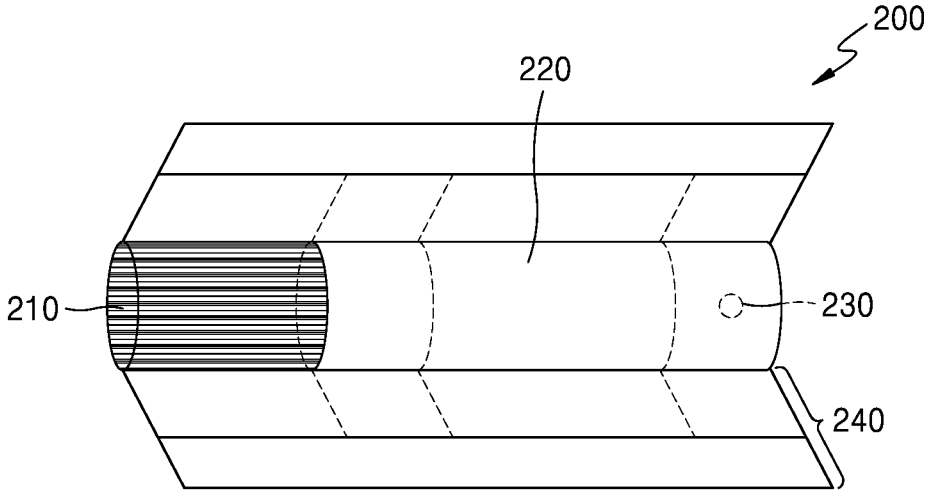
FIG. 4 is a diagram illustrating an example of a cigarette.

FIG. 4 illustrates an example of a cigarette.

Referring to FIG. 4, the cigarette 200 includes a tobacco rod 210 and a filter rod 220. The first portion described above with reference to FIGS. 1 to 3 include the tobacco rod 210 and the second portion includes the filter rod 220.

In FIG. 4, the filter rod 220 is shown as a single segment, but is not limited thereto. In other words, the filter rod 220 may include a plurality of segments. For example, the filter rod 220 may include a first segment for cooling down the aerosol and a second segment for filtering a predetermined component included in the aerosol. Also, if necessary, the filter rod 220 may further include at least one segment performing another function.

The cigarette 200 may be packaged by at least one wrapper 240. The wrapper 240 may include at least one hole through which the outside air is introduced or inside air is discharged. For example, the cigarette 200 may be packaged by one wrapper 240. In another example, the cigarette 200 may be packaged by two or more wrappers 240. For example, the tobacco rod 210 may be packaged by a first wrapper and the filter rod 220 may be packaged by a second wrapper. In addition, the tobacco rod 210 and the filter 220 may be individually packaged, and then, the cigarette 200 may be entirely re-packaged by a third wrapper. When each of the tobacco rod 210 and the filter rod 220 includes a plurality of segments, each of the segments may be packaged by a separate wrapper. In addition, the cigarette 200, including the combined segments respectively packaged by the separate wrappers may be re-packaged by another wrapper.

The tobacco rod 210 includes an aerosol generating material. For example, the aerosol generating material may include at least one of glycerin, propylene glycol, ethylene glycol, dipropylene glycol, diethylene glycol, triethylene glycol, tetraethylene glycol, and oleyl alcohol, but it is not limited thereto. In addition, the tobacco rod 210 may include other additive materials like a flavoring agent, a wetting agent, and/or an organic acid. Also, a flavoring liquid such as menthol, humectant, etc. may be added to the tobacco rod 210 by being sprayed to the tobacco rod 210.

The tobacco rod 210 may be manufactured variously. For example, the tobacco rod 210 may be fabricated as a sheet or a strand. Also, the tobacco rod 210 may be fabricated by tobacco leaves that are obtained by fine-cutting a tobacco sheet. Also, the tobacco rod 210 may be surrounded by a heat conducting material. For example, the heat-conducting material may be, but is not limited to, a metal foil such as aluminum foil. For example, the heat conducting material surrounding the tobacco rod 210 may improve a thermal conductivity applied to the tobacco rod by evenly dispersing the heat transferred to the tobacco rod 210, and thus, improving tobacco taste. Also, the heat conducting material surrounding the tobacco rod 210 may function as a susceptor that is heated by an inducting heating-type heater. Although not shown in the drawings, the tobacco rod 210 may further include a susceptor, in addition to the heat conducting material surrounding the outside thereof.

The filter rod 220 may be a cellulose acetate filter. In addition, the filter rod 220 is not limited to a particular shape. For example, the filter rod 220 may be a cylinder-type rod or a tube-type rod including a cavity therein. Also, the filter rod 220 may be a recess type rod. When the filter rod 220 includes a plurality of segments, at least one of the plurality of segments may have a different shape from the others.

The filter rod 220 may be manufactured to generate flavor. For example, a flavoring liquid may be sprayed to the filter rod 220 or separate fibers on which the flavoring liquid is applied may be inserted in the filter rod 220.

Also, the filter rod 220 may include at least one capsule 230. Here, the capsule 230 may generate flavor or may generate aerosol. For example, the capsule 230 may have a structure, in which a liquid containing a flavoring material is wrapped with a film. The capsule 230 may have a circular or cylindrical shape, but is not limited thereto.

When the filter rod 220 includes a segment for cooling down the aerosol, the cooling segment may include a polymer material or a biodegradable polymer material. For example, the cooling segment may include pure polylactic acid alone, but the material for forming the cooling segment is not limited thereto. In some embodiments, the cooling segment may include a cellulose acetate filter having a plurality of holes. However, the cooling segment is not limited to the above examples, and may include any material provided that a function of cooling down the aerosol is implemented.

Although not shown in FIG. 4, the cigarette 200 according to the embodiment may further include a front-end filter. The front-end filter may be disposed at a side of the tobacco rod 210, the side not facing the filter rod 220. The front-end filter may prevent the tobacco rod 210 from escaping to the outside and may prevent the liquefied aerosol from flowing to the aerosol generator 10 (see FIGS. 1 to 3) from the tobacco rod 210 during smoking.

Figure 5:
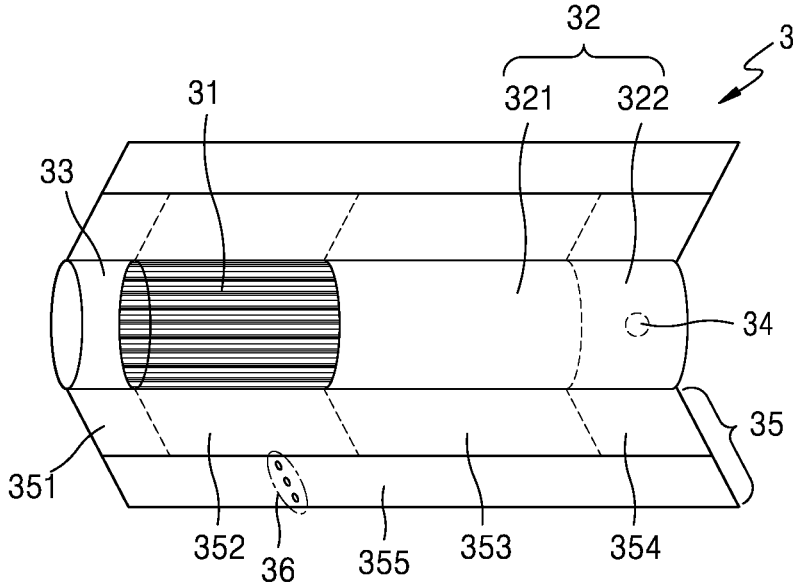
FIG. 5 is a diagram illustrating another example of a cigarette.

Referring to FIG. 5, the cigarette 3 may further include the front-end plug 33. The front-end plug 33 may be located on a side of the tobacco rod 31, the side not facing the filter rod 32.

The filter rod 32 may include a first segment 321 and a second segment 322. Here, the first segment 321 may correspond to the first segment of the filter rod 22 of FIG. 4, and the second segment 322 may correspond to the third segment of the filter rod 22 of FIG. 4.

The diameter and the total length of the cigarette 3 may correspond to the diameter and the total length of the cigarette 2 of FIG. 4.

The cigarette 3 may be wrapped by at least one wrapper 35. At least one hole through which outside air flows in or inside gas flows out may be formed in the wrapper 35. For example, the front-end plug 33 may be wrapped by a first wrapper 351, the tobacco rod 31 may be wrapped by a second wrapper 352, the first segment 321 may be wrapped by a third wrapper 353, and the second segment 322 may be wrapped by a fourth wrapper 354. Also, the entire cigarette 3 may be re-wrapped by a fifth wrapper 355.

Also, the second segment 322 may include at least one capsule 34. Here, the capsule 34 may serve to generate a flavor or aerosol. For example, the capsule 34 may have a structure in which a liquid containing perfume is wrapped in a film. The capsule 34 may have a spherical or cylindrical shape, but is not limited thereto.

The first wrapper 351 may be a metal foil such as aluminum foil bonded to a general filter wrapping paper.

The second wrapper 352 and the third wrapper 353 may be made of a general filter wrapping paper. For example, the second wrapper 352 and the third wrapper 353 may be porous wrapping paper or non-porous wrapping paper.

The front-end plug 33 may be made of cellulose acetate. The mono denier of the filaments constituting the cellulose acetate tow may be in the range of 1.0 to 10.0, and preferably in the range of 4.0 to 6.0. More preferably, the mono denier of the filament of the front-end plug 33 may be 5.0. In addition, the cross-section of the filament constituting the front-end plug 33 may be Y-shaped. The total denier of the front-end plug 33 may be in the range of 20000 to 30000, and preferably in the range of 25000 to 30000. More preferably, the total denier of the front-end plug 33 may be 28000.

In addition, as necessary, the front-end plug 33 may include at least one channel, and the cross-section of the channel may be manufactured in various shapes.

The cigarette rod 31 may correspond to the cigarette rod 21 of FIG. 5. Therefore, hereinafter, detailed description of the cigarette rod 31 is omitted.

The first segment 321 may be made of cellulose acetate. For example, the first segment may be a tube-shaped structure containing a hollow therein. For example, the mono denier and total denier of the first segment 321 may be the same as the mono and total denier of the front-end plug 33, respectively.

The second segment 322 may be made of cellulose acetate. The mono denier of the filaments constituting the second segment 322 may be in the range of 1.0 to 10.0, and preferably may be in the range of 8.0 to 10.0. More preferably, the mono denier of the filament of the second segment 322 may be 9.0. In addition, the cross-section of the filament of the second segment 322 may be Y-shaped. The total denier of the second segment 322 may be in the range of 20000 to 30000, and preferably may be 25000.

The total denier of the second segment 322 may be in the range of 20000 to 30000, and preferably may be 25000.

According to an embodiment of the present disclosure, a cigarette for an aerosol generating device includes a tobacco rod in which an aerosol generating substrate is wrapped with a wrapper and a filter through which the aerosol generated from the aerosol generating substrate passes. The filter may be made of cellulose acetate tow having a total denier of a preset value. The tobacco rod including an aerosol generating substrate wrapped with a wrapper may correspond to the tobacco rod 210 of FIG. 4, and the filter through which the aerosol generated from the aerosol generating substrate may correspond to the filter rod 220 of FIG. 4.

In that case, the filter may be made of acetate tow having a total denier of a preset value. When a plurality of fibers in a filament state are considered, the total denier refers to a combined denier of the bundle. More specifically, the total denier refers to a total weight of a group of fiber filaments of 9,000 m which are bound without wrinkles. According to an optional embodiment, the total denier of the filter included in the cigarette according to the present disclosure may be a value selected from within a preset range. For example, the total denier of the tow may be set as any one value selected from within a range of 22,000 denier to 25,000 denier. According to a preferred embodiment different from the foregoing example, the total denier of the tow may be 25,000 denier.

There is a mono denier, which is an index corresponding to the total denier of the filter. The mono denier refers to a weight per unit length of a single strand of fiber in a filament state, and the unit length is 9,000 m, which is equal to that of the total denier. For example, in the case of a fiber having a mono denier of 5, the weight of 9000 m of the fiber may be 5 g.

According to one or more embodiments of the present disclosure, a value of the mono denier may be changed to a value within a specific range while the total denier is fixed at a preset value or a preset value selected from within a preset range, thereby increasing an atomization amount of the cigarette for an aerosol generating device.

acetate tow is set at 9.0. As shown in embodiments of the present disclosure, when the mono denier is increased while the total denier is fixed at a constant value, the density of fiber bundle of the filter contacting the aerosol passing through the filter becomes lower. As a result, the suction resistance may be lowered under the same tow weight, which in turn may lead to an increase in an amount of atomization amount generated by an aerosol generating device.

Referring to Tables 1 and 2, it may be identified that under the same total denier condition, when the mono denier of the

TABLE 1

| Tow | Item | Shape of filter | Tow weight (mg) | Filter weight (mg) | Suction resistance ($mmH_2O$) | Circumference (mm) | Roundness (%) | Hardness (%) |
|---|---|---|---|---|---|---|---|---|
| 9.0Y/25k | control group | mono | 380 | 605 | 145.1 | 22.0 | 96.5 | 83.5 |
| | | capsule filter 1 | | 796 | 194.6 | 21.9 | 95.6 | 88.0 |
| | | capsule filter 2 | 415 | 893 | 218.7 | 22.0 | 97.1 | 88.1 |

Table 1 shows quality evaluation results of a filter made of acetate tow having a mono denier of 9.0 and a total denier of 25,000. The quality evaluation results illustrated in Table 1 are a control group for comparison with quality evaluation results illustrated in Table 2 below. Alphabet Y behind the mono denier indicates a shape of cross-sectional area of the acetate tow, which will be described herein below with reference to FIGS. 6 and 7.

acetate tow is set at 11.7, hardness of the filter is increased by about 3% compared to when the mono denier of the acetate tow is set at 9.0. As a specific example, in Tables 1 and 2, the hardness of the filter having the weight of 923 mg and the mono denier of 11.7 denier is 91.1%, which is about 3% higher than 88.1%, which is the hardness of the filter having the weight of 893 mg and the mono denier of 9.0. Here, the hardness of the filter has been measured using a

TABLE 2

| Tow | Item | Shape of filter | Tow weight (mg) | Filter weight (mg) | Suction resistance ($mmH_2O$) | Circumference (mm) | Roundness (%) | Hardness (%) |
|---|---|---|---|---|---|---|---|---|
| 11.7Y/25k | Tow weight | mono | 420 | 659 | 147.5 | 21.9 | 96.7 | 89.9 |
| | | capsule filter 1 | | 841 | 195.0 | 21.9 | 96.9 | 92.9 |
| | | capsule filter 1 | 440 | 923 | 219.1 | 22.0 | 97.5 | 91.1 |
| | Increase in TJNS flavor | capsule filter 2 | | 941 | 214.6 | 22.0 | 97.5 | 90.4 |
| | Suction resistance downward | capsule filter 1 | 400 | 821 | 164.8 | 21.9 | 96.2 | 91.5 |
| | | capsule filter 2 | 425 | 905 | 189.5 | 22.0 | 97.4 | 89.2 |

Table 2 shows quality evaluation results of a filter made of acetate tow having a mono denier of 11.7 and a total denier of 25,000. Comparing Tables 1 and 2, it may be identified that under the same suction resistance condition, when applying acetate tow having 11.7 Y/25,000, a weight of the tow is increased by about 10% compared to when applying acetate tow having 9.0 Y/25,000. For example, a weight of the filter having the suction resistance of 145.1 mmH20 is 380 mg in Table 1, and the weight of the filter having the suction resistance of 147.5 mmH20, which is practically equal to 145.1 mmH20, is 420 mg in Table 2. That is, as the mono denier alone is increased from 9.0 to 11.7 while the total denier of the tow is fixed at 25,000, the weight of the tow is increased by about 10%. Interpreting the above comparison results, it may be identified that when the weight of the filter and the total denier are fixed, if the mono denier of the acetate tow is set at 11.7, the suction resistance may be about 15% lower than when the mono denier of the KARDIEN Test-Station. However, according to embodiments of the present disclosure, the hardness of the filter may be measured through measurement devices other than the KARDIEN Test-Station.

Recently, some aerosol generating devices use a flavoring agent as an aerosol generating substrate. In this case, the hardness of the filter may decrease as the amount of flavoring applied thereto increases. According to one or more embodiments of the present disclosure, by limiting the mono denier to a constant value corresponding to the total denier while the total denier is fixed at a preset value, the suction resistance may be decreased and also the hardness of the filter may be increased.

For ease of descriptions, Tables 1 and 2 assume that the mono denier of the control group is limited to 9.0 and the mono denier of the tow used in the filter according to embodiments of the present disclosure is limited to 11.7. However, according to embodiments of the present disclosure, the mono denier of cellulose acetate tow used in the filter according to embodiments of the present disclosure may be a preset value, which is less than or equal to 13 or may be any one value between 9 and 13.

TABLE 3

| ITEM | TOW ITEM | WEIGHT (mg) | SUCTION RESISTANCE ($mmH_2O$) | COMPOSITION OF SMOKE (mg/STICK) TPM | Nicotine | Glycerine | APPLIED FILTER |
|---|---|---|---|---|---|---|---|
| CONTROL GROUP | 9.0/25k | 893 | 219 | 40.69 | 0.66 | 2.55 | CAPSULE FILTER 1 |
| TEST GROUP 1 | 11.7/25k | 923 | 219 | 40.71 | 0.70 | 3.07 | |
| TEST GROUP 2 | 11.7/25k | 859 | 170 | 41.18 | 0.74 | 3.06 | |

[96] Table 3 shows that when the mono denier of cellulose acetate tow (hereinafter "tow") used in the filter is increased from 9.0 to 11.7, another effect is generated. In Table 3, the control group is a cigarette using a filter made of tow having the mono denier of 9.0, and test groups 1 and 2 are cigarettes using filters made of tow having the mono denier of 11.7. The difference between the test groups 1 and 2 lies in whether the suction resistance is set equal to the control group by regulating the weight of the tow. Referring to Table 3, it may be identified that as the mono denier is increased from 9.0 to 11.7 while the total denier is fixed at 25,000, an amount of glycerin migration increases. Here, the glycerin is a kind of the liquid composition stored in the liquid storage of the vaporizer 140 as described in FIGS. 2 and 3. When the mono denier is increased from 9.0 to 11.7 while the total denier is fixed at 25,000, it is possible to solve a problem that the amount of glycerin migration decreases during smoking in existing heating-type aerosol generating devices.

Comparing the test group 2 with the control group and the test group 1 of Table 3, respectively, it may be identified that even when the suction resistance is significantly decreased by reducing the weight of the tow, since the mono denier is increased while the total denier is maintained at 25,000, the amount of glycerin migration is still large compared to the control group. Unlike the glycerin, a total particulate matter (TPM), tar, and nicotine are not significantly affected by increased mono denier.

TABLE 4

| ITEM | CONTENT OF PLASTICIZER (%) TUBE FILTER | CAPSULE FILTER | COMPOSITION OF SMOKE (mg/STICK) TPM | Nicotine | Glycerine | APPLIED FILTER |
|---|---|---|---|---|---|---|
| CONTROL GROUP 1 | 19 | 15 | 42.64 | 0.91 | 3.02 | CAPSULE FILTER 1 |
| TEST GROUP 1 | 12 | 15 | 42.77 | 0.90 | 2.70 | |
| TEST GROUP 2 | 24 | 15 | 43.92 | 0.88 | 3.45 | |

Table 4 illustrates that the amount of glycerin migration may be increased during smoking through the aerosol generating device according to another embodiment. More specifically, Table 4 shows results of comparing the amount of glycerin migration between the control group and the test groups while maintaining the content of a plasticizer of a capsule filter at 15% and changing only the content of the plasticizer of a tube filter. Referring to Table 4, it may be identified that when the content of the plasticizer used to manufacture the tube filter is increased from 12% to 24%, the amount of glycerin migration is increased from 2.70 to 3.45. As described above, according to one or more embodiments of the present disclosure, the amount of glycerin migration may be increased during smoking by increasing the mono denier by a certain amount or greater while maintaining the total denier, or by increasing the amount of the plasticizer of the tube filter constituting the cigarette from 12% to 24%.

According to an optional embodiment different from the above example, the cigarette according to one or more embodiments of the present disclosure may include a filter made of cellulose acetate tow having a total denier of a preset value, and a cross-sectional area of the filter may be in a Y or O shape.

Figure 6:
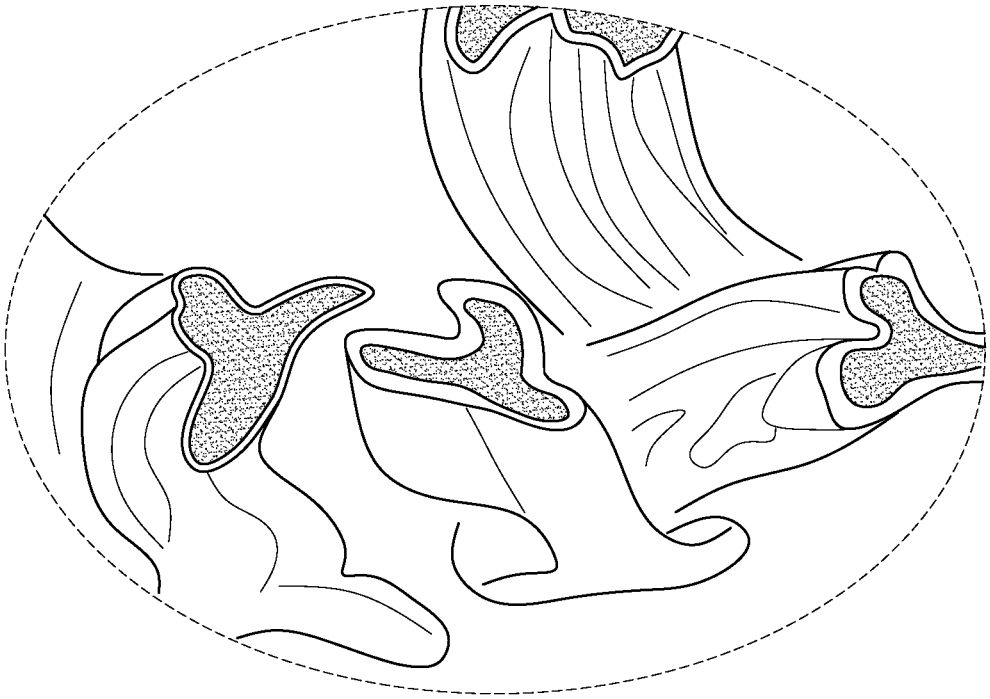
FIGS. 6 and 7 are diagrams illustrating a cross-sectional area of cellulose acetate tow in Y and O shapes, respectively.
Figure 7:
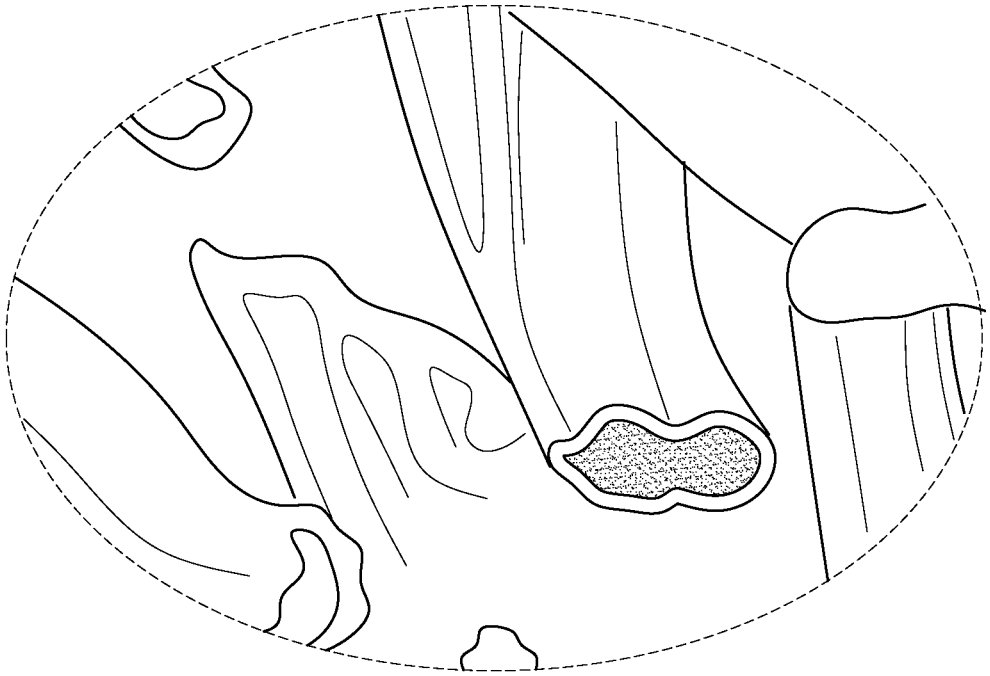

FIGS. 6 and 7 are diagrams illustrating a Y-shaped cross-sectional area and an O-shaped cross-sectional area of cellulose acetate tow, respectively.

FIG. 6 is a schematic diagram illustrating the cross-sectional area of the cellulose acetate tow having a Y-shaped cross-sectional area. The cross-sectional area through which an aerosol passes is relatively much larger when the filter is made of the tow having a Y-shaped cross-sectional area than when the filter is made of tow having a different-shaped cross-sectional area. This means that a surface of the fiber of the filter which the aerosol contacts is large. When the cross-sectional area of the tow is Y-shaped, there is an advantage in that harmful substances, such as tar coming out of the filter may be minimized. Meanwhile, there is a limitation in that the atomization amount may not be rich due to the high filtering strength. Referring to FIG. 6, it may be identified that the cross-sectional area of the tow has a shape similar to alphabet Y.

FIG. 7 is a schematic diagram illustrating the O-shaped cross-sectional area of tow. The cross-sectional area through which the aerosol passes is relatively smaller when the filter is made of the tow having an O-shaped cross-sectional area than when the filter is made of the tow having a Y-shaped cross-sectional area. Therefore, the amount of glycerin migration is increased and the hardness of the filter tends to increase due to structural properties, in the process of smoking by a user using the aerosol generating device. Similar to FIG. 6, FIG. 7 shows a cross-sectional area of the tow, which has a distorted O shape.

TABLE 5

| Tow Item | LENGTH OF FILTER (mm) | SUCTION RESISTANCE ($mmH_2O$) | WEIGHT (mg) | CIRCUMFERENCE (mm) | ROUNDNESS (%) | HARDNESS (%) |
|---|---|---|---|---|---|---|
| 9.0Y/25k (MONO) | 96 | 149.7 | 395 | 21.99 | 95.94 | 83.2 |
| 9.0Y/25k (CAPSULE FILTER 1) | | 193.1 | | 22.04 | 96.30 | 89.4 |
| 9.0O/25k (MONO) | | 144.0 | 475 | 21.93 | 96.04 | 88.2 |
| 9.0O/25k (CAPSULE FILTER 1) | | 192.8 | | 21.96 | 96.32 | 93.4 |

Table 5 shows that the hardness of the filter and the weight of the tow are changed when the cross-sectional area of the tow is changed from a Y shape to an O shape while the mono denier of the tow is fixed to 9.0 denier and the total denier of the tow is fixed to 25,000. Referring to FIG. 5, when the cross-sectional area of the tow is changed from a Y shape to an O shape under the same mono denier and total denier of the tow, the hardness of the filter and the weight of the tow are increased. When the cross-sectional area of the tow is changed from a Y shape to an O shape, the weight of the tow becomes greater at the same suction resistance. This means that when the cross-sectional area of the tow is O-shaped, although more tow is used, the suction resistance is the same as when the cross-sectional area of the tow is Y-shaped. Therefore, the filter made of the tow having an O-shaped cross-sectional area may have a lower filtering ability than the filter made of the tow having a Y-shaped cross-sectional area, thereby increasing the atomization amount of the aerosol coming out of the filter.

According to an embodiment, when the cross-sectional area of the tow is changed from a Y shape to an O shape while the mono denier and total denier of the tow are maintained at the pre-set value, the atomization amount of the aerosol generating device is increased and the hardness of the filter is increased. According to another embodiment, when the mono denier of the tow is increased (for example, from 9.0 to 11.7) while the shape of the cross-sectional area and the total denier of the tow are fixed, the atomization amount of the aerosol generating device is increased and the hardness of the filter is increased. Thus, the two embodiments above may achieve practically the same resultant effect.

Table 6 illustrates how much of capsule leakage is absorbed after the capsule is crushed under the same suction resistance when the cross-sectional area of the tow is changed from a Y shape to an O shape while the mono denier and total denier of the tow are maintained at the pre-set value. More specifically, Table 6 shows a weight loss rate before and after the capsule is crushed, based on a 96 mm rod capsule filter. Referring to Table 6, it may be identified that the filter of the test group having an O-shaped cross-sectional area of the tow shows little difference (0.04%) in weights before and after the capsule is crushed, compared to the filter of the control group having a Y-shaped cross-sectional area of the tow. On the other hand, Table 6 shows that the weight loss rate of the filter manufactured according to the control group having a Y-shaped cross-sectional area of the tow is 0.24% before and after the capsule is crushed, which is relatively higher than the weight loss rate (0.04%) of the filter of the test group having an O-shaped cross-sectional area of the tow.

The difference as shown in Table 6 is derived from the fact that since the weight of the filter has increased due to the change in the shape of the cross-sectional area of the tow under the same suction resistance as described in FIG. 5, the amount of a scent to be contained has increased. As shown in Table 6, since the weight of the tow may be increased under the same suction resistance when the cross-sectional area of the tow is changed to the O shape, and much of the capsule leakage that is generated by a user crushing a capsule may be absorbed. As such, contamination of the aerosol generating device due to the capsule leakage may be minimized. Also, the capsule may be prevented from being moved to the side within the filter.

As another optional embodiment different from the above embodiment, the cigarette for an aerosol generating device according to one or more embodiments of the present disclosure may include a cigarette including a filter made of

TABLE 6

| | Tow Item | WEIGHT BEFORE CRUSHING (mg) | WEIGHT AFTER CRUSHING (mg) | WEIGHT LOSS RATE BEFORE AND AFTER CRUSHING (%) | APPLIED FILTER | REMARK |
|---|---|---|---|---|---|---|
| CONTROL GROUP | 9.0Y/25k | 799.5 | 1.90 | 0.24 | CAPSULE FILTER 1 | Y-SHAPED CROSS-SECTION |
| TEST GROUP | 9.0O/25k | 879.5 | 879.1 | 0.04 | CAPSULE FILTER 2 | O-SHAPED CROSS-SECTION |

acetate tow having a total denier which is a preset value and a mono denier which is a reference value. Depending on embodiments, the ratio of the total denier and the mono denier may be a ratio for lowering the suction resistance of the filter than a preset suction resistance or for increasing the hardness of the filter to be greater than a preset hardness of the filter. Therefore, once the total denier of the tow is set to a specific constant, the mono denier of the tow may also be decided.

One or more embodiments described above may be implemented in the form of a computer program that may be executed on a computer through various components, and such a computer program may be recorded in a computer-readable recording medium. At this time, the computer-readable recording medium may be a magnetic medium (e.g., a hard disk, a floppy disk, and a magnetic tape), an optical recording medium (e.g., a CD-ROM and a DVD), a magneto-optical medium (e.g., a floptical disk), and a hardware device specifically configured to store and execute program instructions (e.g., a ROM, a RAM, and a flash memory).

Meanwhile, the computer program recorded on the medium may be specially designed and configured for example embodiments or may be published and available to one of ordinary skill in computer software. Examples of computer programs include machine language code such as code generated by a compiler, as well as high-level language code that may be executed by a computer using an interpreter or the like.

Specific implementations described in one or more embodiments are examples, and do not limit the scope of one or more embodiments in any way. For brevity of description, descriptions of conventional electronic components, control systems, software, and other functional aspects of the systems may be omitted. Furthermore, the connecting lines, or connectors shown in the various figures presented are intended to represent exemplary functional relationships and/or physical or logical couplings between the various elements, and it should be noted that many alternative or additional functional relationships, physical connections or circuit connections may be present in a practical device. Moreover, no item or component is essential to the practice of one or more embodiments unless the element is specifically described as "essential" or "critical".

The use of the terms "a" and "an" and "the" and similar referents in the context of describing one or more embodiments (especially in the context of the following claims) are to be construed to cover both the singular and the plural. Furthermore, recitation of ranges of values herein are merely intended to serve as a shorthand method of referring individually to each separate value falling within the range, unless otherwise indicated herein, and each separate value is incorporated into the specification as if it were individually recited herein. Also, the steps of all methods described herein can be performed in any suitable order unless otherwise indicated herein or otherwise clearly contradicted by context. One or more embodiments are not limited to the described order of the steps. The use of any and all examples, or exemplary language (e.g., "such as") provided herein, is intended merely to better illuminate the present disclosure and does not pose a limitation on the scope of one or more embodiments unless otherwise claimed. Numerous modifications and adaptations will be readily apparent to one of ordinary skill in the art without departing from the spirit and scope of one or more embodiments.

INDUSTRIAL APPLICABILITY

One or more embodiments of the present disclosure may be utilized for producing a next-generation electronic cigarette and a cigarette included in the next-generation electronic cigarette.

What is claimed is:

1. A cigarette for an aerosol generating device, comprising:

a tobacco rod including an aerosol generating substrate wrapped with a wrapper; and a filter through which an aerosol generated from the aerosol generating substrate passes to a user, wherein the filter comprises a cellulose acetate tow having a total denier in a range of 22,000 to 25,000 and comprising a plasticizer in a range of 15% to 24%, wherein the filter includes at least one capsule, and the filter is made of acetate tow having a mono denier of 9 and having an O-shaped cross-sectional area, and wherein, a weight of the cellulose acetate tow is 475 mg, and when the capsule is crushed by the user, a weight loss rate before crushing relative to after crushing is 0.04%.

2. The cigarette for an aerosol generating device of claim 1, wherein the total denier is 25,000.

3. An aerosol generating device which generates aerosol by heating the cigarette according to claim 1.

* * * * *